US009056495B2

(12) United States Patent
Mizes et al.

(10) Patent No.: US 9,056,495 B2
(45) Date of Patent: Jun. 16, 2015

(54) SYSTEM AND METHOD FOR IMAGING AND EVALUATING COATING ON AN IMAGING SURFACE IN AN AQUEOUS INKJET PRINTER

(71) Applicant: Xerox Corporation, Norwalk, CT (US)

(72) Inventors: Howard A. Mizes, Pittsford, NY (US); Jeffrey J. Folkins, Rochester, NY (US); Chu-heng Liu, Penfield, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 104 days.

(21) Appl. No.: 13/720,333

(22) Filed: Dec. 19, 2012

(65) Prior Publication Data

US 2014/0168304 A1 Jun. 19, 2014

(51) Int. Cl.
*B41J 2/005* (2006.01)
*B41J 11/00* (2006.01)

(52) U.S. Cl.
CPC ..... *B41J 11/0015* (2013.01); *B41J 2/0057* (2013.01)

(58) Field of Classification Search
USPC ..... 347/19, 15, 9
See application file for complete search history.

(56) References Cited

U.S. PATENT DOCUMENTS

| | | | | |
|---|---|---|---|---|
| 5,389,958 | A * | 2/1995 | Bui et al. | 347/103 |
| 6,263,182 | B1 * | 7/2001 | Baker et al. | 399/325 |
| 6,335,978 | B1 | 1/2002 | Moscato et al. | |
| 7,686,445 | B2 | 3/2010 | Fioravanti et al. | |
| 7,866,782 | B2 * | 1/2011 | Borton | 347/19 |
| 7,869,099 | B2 | 1/2011 | Mashtare | |
| 8,132,885 | B2 | 3/2012 | Ramakrishnan et al. | |
| 8,220,917 | B2 * | 7/2012 | Taniuchi et al. | 347/103 |
| 8,506,038 | B2 * | 8/2013 | Mizes et al. | 347/19 |
| 2003/0133728 | A1 * | 7/2003 | Caruthers et al. | 399/296 |
| 2008/0035002 | A1 * | 2/2008 | Kuo | 101/480 |
| 2009/0040261 | A1 * | 2/2009 | Zhang et al. | 347/19 |
| 2009/0085952 | A1 * | 4/2009 | Yamazaki | 347/19 |
| 2012/0056928 | A1 * | 3/2012 | Powers et al. | 347/19 |

* cited by examiner

*Primary Examiner* — Matthew Luu
*Assistant Examiner* — Lily Kemathe
(74) *Attorney, Agent, or Firm* — Maginot Moore & Beck LLP

(57) ABSTRACT

An inkjet printer is configured to apply a coating material to an imaging surface before an ink image is formed on the surface. At least one optical sensor generates image data of the coating on the imaging surface and identifies a thickness of the coating material. Components of the coating material applicator can be adjusted to keep the thickness of the coating material within a predetermined range.

9 Claims, 4 Drawing Sheets

SYSTEM AND METHOD FOR IMAGING AND EVALUATING COATING ON AN IMAGING SURFACE IN AN AQUEOUS INKJET PRINTER

TECHNICAL FIELD

This disclosure relates generally to indirect inkjet printers, and, in particular, to surface preparation for inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. To address this issue, indirect printers have been developed that eject ink onto a blanket mounted to a drum or endless belt. The ink is dried on the blanket and then transferred to media. Such a printer avoids the changes in media properties that occur in response to media contact with the water or solvents in aqueous ink. Indirect printers also reduce the effect of variations in other media properties that arise from the use of widely disparate types of paper and films used to hold the final ink images.

In these indirect printers, the blanket surface must wet well enough to prevent significant coalescence of the ink on the surface and also facilitate the release of the ink from the blanket to the media after the ink has dried on the blanket. Applying a coating material to the blanket can facilitate the wetting of the blanket surface and the release of the ink image from the blanket surface. Coating materials have a variety of purposes that include wetting the blanket surface, inducing solids to precipitate out of the liquid ink, providing a solid matrix for the colorant in the ink, and/or aiding in the release of the printed image from the blanket surface. Because the blanket surfaces are likely to be surfaces with low surface energy, reliable coating is a challenge. If the coating is too thin, it may fail to form a layer adequate to support an ink image. If the coating is too thick, a disproportionate amount of the coating may be transferred to the media with the final image. Image defects arising from either phenomenon may significantly degrade final image quality.

In previously known indirect printers, operators observe the ink images on the media output by the printer and evaluate the quality of the ink images. The operator can adjust various parameters for the printer and repeat the evaluation of the image quality. Once the operator determines the image quality is adequate, the operator commences a print run. Such trial-and-error techniques are prone to operator subjectivity and color sensitivity. Improvements in aqueous indirect inkjet printers that enable more objective evaluations and consistent coating layers are desirable.

SUMMARY

A printer has been configured to provide objective evaluations of a coating layer in an inkjet printer and to operate components in the printer to maintain the coating layer within a predetermined range of thicknesses. The printer includes at least one printhead configured to eject liquid ink, and a rotating member being positioned to rotate in front of the at least one printhead to enable the at least one printhead to eject liquid ink and form an ink image on a surface of the rotating member. A coating applicator is positioned with reference to the rotating member to apply a coating material to the surface of the rotating member before the ink image is formed on the surface of the rotating member by the at least one printhead, and at least one optical sensor is configured to generate image data of the surface of the rotating member. A controller is operatively connected to the at least one optical sensor and is configured to receive from the at least one optical sensor image data of the surface of the rotating member, identify a thickness of the coating on the surface of the rotating member with reference to the optical sensor image data, and adjust operation of the coating applicator in response to the thickness not being within a predetermined range.

A method of printer operation enables objective evaluations of a coating layer and adjustments of components to maintain the coating layer within a predetermined range of thicknesses. The method includes delivering firing signals to at least one printhead to eject liquid ink onto a surface of a rotating member positioned to rotate in front of the at least one printhead to form an ink image on the surface of the rotating member, and applying a coating material to the surface of the rotating member before the ink image is formed on the surface of the rotating member by the at least one printhead. Image data of the coating on the surface of the rotating member is generated with at least one optical sensor. These image data are used to identify a thickness of the coating on the surface of the rotating member with reference to the optical sensor image data, and adjust operation of the coating applicator in response to the thickness not being within a predetermined range.

DETAILED DESCRIPTION

Figure 1:
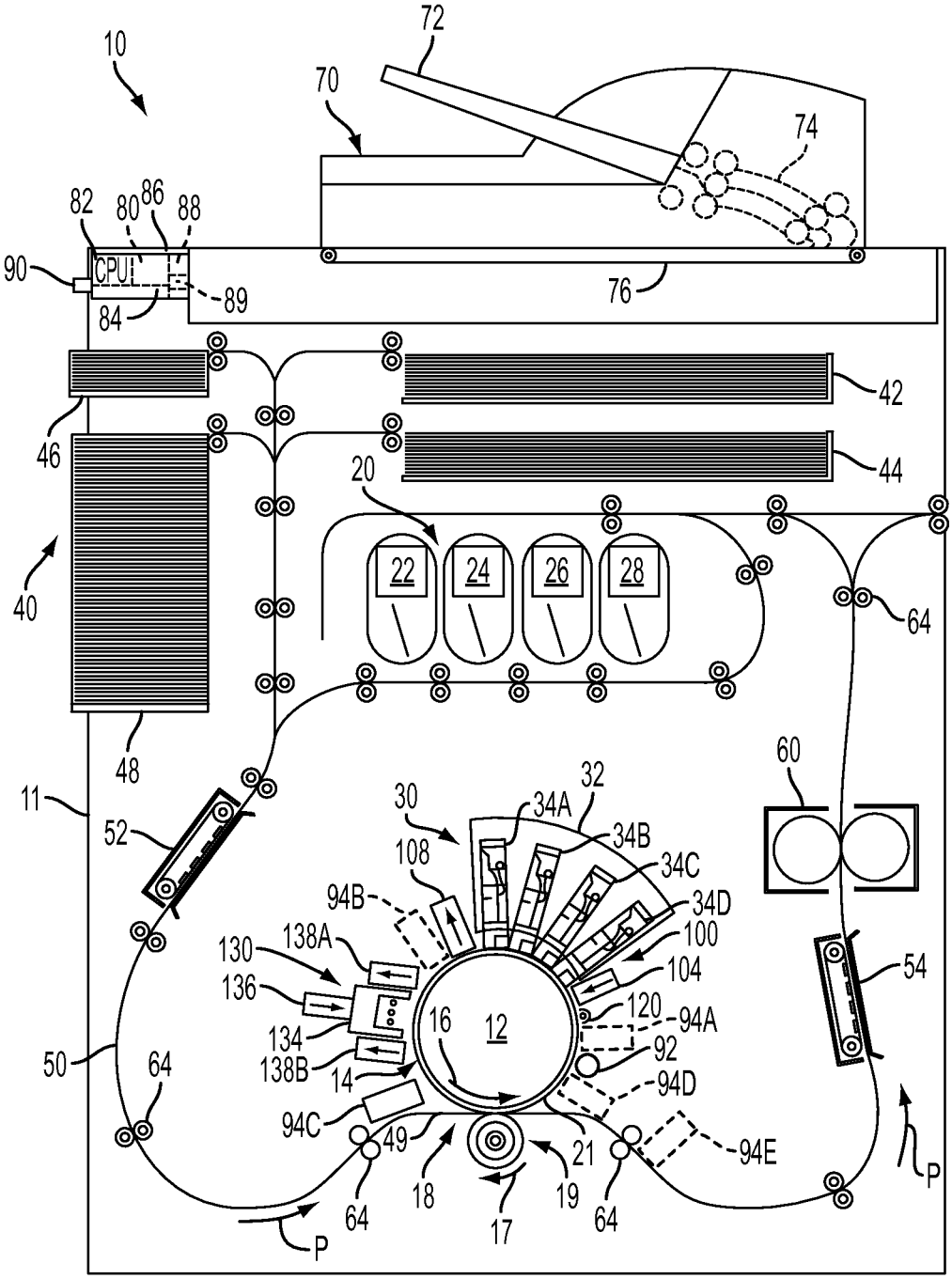
FIG. 1 is a schematic drawing of an aqueous indirect inkjet printer that produces images on sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. As used in this document, the term "aqueous ink" includes liquid inks in which colorant is in solution with water and/or one or more solvents.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

FIG. 1 illustrates a high-speed aqueous ink image producing machine or printer 10. Although the description of the system and method that enables measurement of a coating thickness on the imaging surface is directed to an aqueous inkjet printer, the reader should appreciate that the system and method can be used in other liquid inkjet printers. Use of the system and method in aqueous inkjet printers, however, is particularly novel as the surface energy of the imaging surface needs to change during the print cycle as noted above.

As illustrated, the printer 10 is an indirect printer that forms an aqueous ink image on a surface of a blanket 21 mounted about an intermediate receiving member 12 and then transfers the ink image to media passing through a nip 18 formed with the blanket 21 and intermediate imaging member 12. The printer 10 includes a frame 11 that supports directly or indirectly operating subsystems and components, which are described below. The printer 10 includes an image receiving member 12 that is shown in the form of a drum, but can also be configured as a supported endless belt. The image receiving member 12 has an outer blanket 21 mounted about the circumference of the member 12. The blanket moves in a direction 16 as the member 12 rotates. A transfix roller 19 rotatable in the direction 17 is loaded against the surface of blanket 21 to form a transfix nip 18, within which ink images formed on the surface of blanket 21 are transfixed onto a media sheet 49.

The blanket is formed of a material having a relatively low surface energy to facilitate transfer of the ink image from the surface of the blanket 21 to the media sheet 49 in the nip 18. Such materials include silicones, fluro-silicones, Viton, and the like. A surface maintenance unit (SMU) 92 removes residual ink left on the surface of the blanket 21 after the ink images are transferred to the media sheet 49. The low energy surface of the blanket does not aid in the formation of good quality ink images because such surfaces do not spread ink drops as well as high energy surfaces. Consequently, some embodiments of SMU 92 also apply a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like. In other embodiments, a surface energy applicator 120, which is described in more detail below, operates to treat the surface of blanket for improved formation of ink images without requiring application of a coating by the SMU 92.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material such as anilox. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface of the blanket 21.

The printer 10 includes an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. As used in this document, "white light" means light that has approximately equal amounts of energy over all wavelengths of the visible spectrum. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also includes a surface energy applicator 120 positioned next to the blanket surface at a position immediately prior to the surface of the blanket 21 entering the print zone formed by printhead modules 34A-34D. The surface energy applicator 120 can be, for example, a corotron, a scorotron, or biased charge roller. The coronode of a scorotron or corotron used in the applicator 120 can either be a conductor in an applicator operated with AC or DC electrical power or a dielectric coated conductor in an applicator supplied with only AC electrical power. The devices with dielectric coated coronodes are sometimes referred to as dicorotrons or discorotrions.

The surface energy applicator 120 is configured to emit an electric field between the applicator 120 and the surface of the blanket 21 that is sufficient to ionize the air between the two structures and apply negatively charged particles, positively charged particles, or a combination of positively and negatively charged particles to the blanket surface and/or the coating. The electric field and charged particles increase the surface energy of the blanket surface and/or coating. The increased surface energy of the surface of the blanket 21 enables the ink drops subsequently ejected by the printheads in the modules 34A-34D to be spread adequately to the blanket surface 21 and not coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes an infrared heater 134, a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the image receiving member 12 onto the media sheet 49.

The rotation or rolling of both the image receiving member 12 and transfix roller 19 not only transfixes the images onto the media sheet 49, but also assists in transporting the media sheet 49 through the nip. The image receiving member 12 continues to rotate to continue the transfix process for the images previously applied to the coating and blanket 21.

Figure 2:
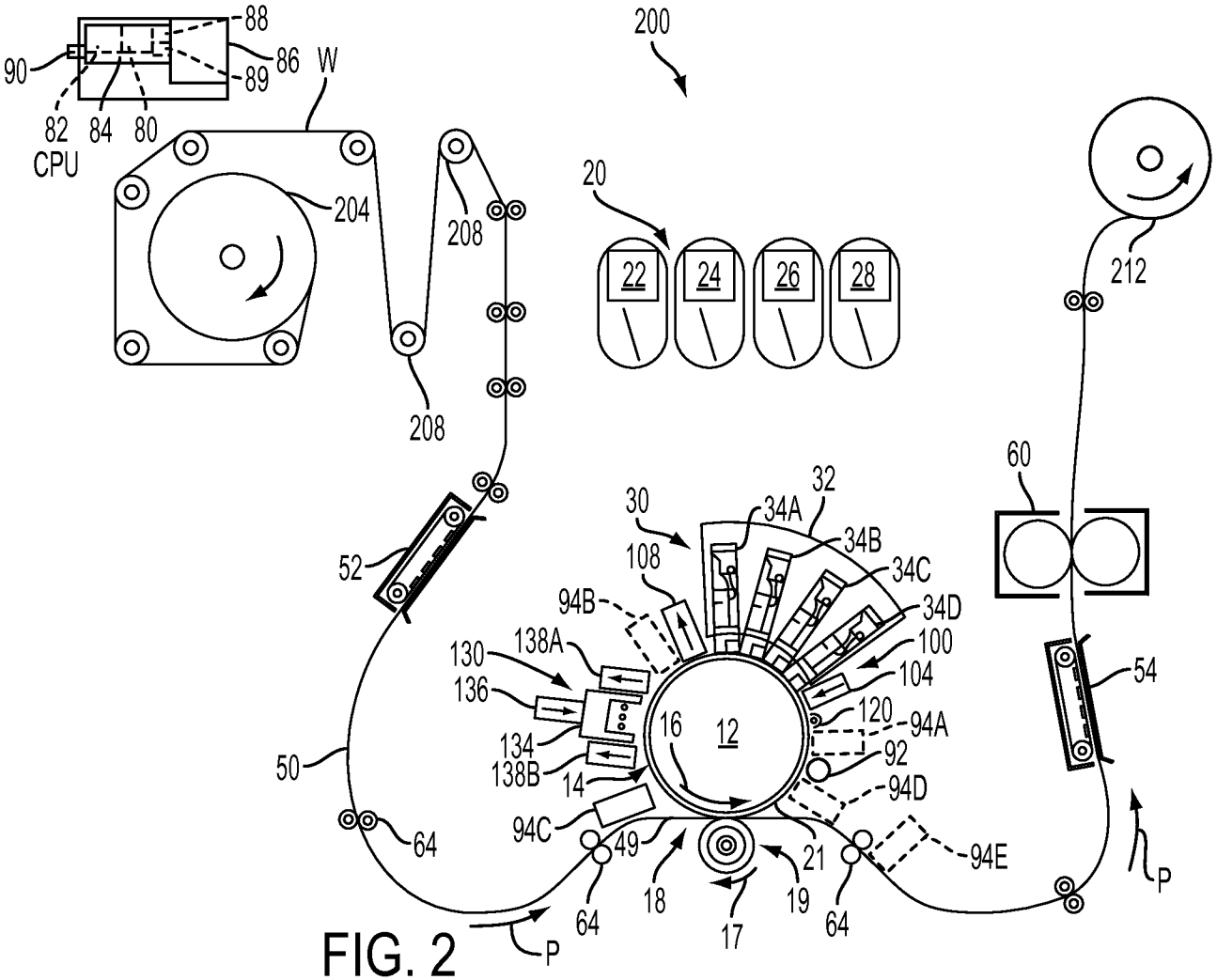
FIG. 2 is a schematic drawing of an aqueous indirect inkjet printer that produces images on a continuous web of media.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. One configuration of the printer 200 winds the printed media onto a roller for removal from the system by rewind unit 214. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in this embodiment in synchronization with the arrival of media at the nip to receive an ink image and is separated from the blanket to remove the nip as the trailing edge of the media leaves the nip.

As noted above, an aqueous printer having the structure shown in FIG. 1 or FIG. 2 can have one optical sensor 94A, 94B, 94C, or 94D, or any combination or permutation of image sensors at these positions about the rotating member 12. The advantage of having multiple image sensors is that the print cycle can be completed in a single revolution of the rotating member. When only one image sensor is provided in a printer, then an operation must occur with respect to a portion of the imaging surface followed by continued rotation of the imaging surface so that portion reaches the optical sensor, which is operated to generate image data of the surface that can be analyzed to evaluate the operation. The imaging surface then continues to rotate until the portion of the surface that was imaged reaches the next operational station position so an operation can be performed, the surface rotated until that portion reaches the optical sensor for imaging to evaluate the next operation performed on the surface. For example, in a printer embodiment having a single optical sensor, the imaging member continues rotation following surface treatment of a portion of the imaging member by the surface energy applicator 120 without operating the printheads 34A to 34D to eject ink or activating the heater 130 so the treated portion of the imaging surface can be imaged by optical sensor 94C, when optical sensor 94C is the only optical sensor in the printer. The rotation of the imaging member continues until the treated portion begins to pass the printheads and then the printheads are operated to eject ink onto the treated portion to form an ink image. The ink image may or may not be subjected to heat from heater 130 before being imaged by the optical sensor 94C. Once the image is transferred, the imaging member can be rotated until the portion of the imaging surface where the ink image was formed passes the optical sensor 94C so image data of the surface can be generated to evaluate the efficiency of the image transfer. This type of multi-pass print cycle can be used to enable printer embodiments with only one optical sensor or less than all of the optical sensors 94A, 94B, 94C, and 94D to generate image data of the imaging member surface to scrutinize the performance of various components in the printer.

As noted above, the SMU 92 is configured to deposit and distribute coating material onto the surface of the blanket and remove un-transferred ink pixels from the surface of the blanket 21. The thickness of the material needs to be within a predetermined range or adverse consequences may impact the quality of the images produced. Analysis of the image data generated by either sensor 94A or 94B in a single revolution print cycle or a single optical sensor in a multi-revolution print cycle can be used to identify the thickness of the coating and make adjustments to the SMU 92, if the thickness is not within the predetermined range.

In one embodiment, the thickness of the coating on the blanket surface is determined with thin film interference measurements. This approach is particularly useful for measuring smooth coating thicknesses in a range of about 0.1 μm to about 1.0 μm on a smooth blanket surface. The presence of a clear coating or an absorbent coating with a thickness on the order of the wavelength or less of the source light of the optical sensor on a reflective surface changes the reflection of specularly reflected light. The change in the reflection is dependent on the wavelength and angle of incidence of the incident light, the thickness and index of refraction of the coating, and the structure of the coating. The reflection of the incident light by the bare blanket surface is captured repeatedly by the optical sensor to establish a baseline. The coated blanket surface is then imaged by the optical sensor with light of the same spectrum as the light used to establish the baseline. The change in the specular reflection can be correlated to the thickness of the coating. The thickness can be calculated from knowledge of the dielectric constant of the coating and the substrate. In one embodiment, the signals of the optical sensor are captured and stored for a plurality of coating thicknesses, which are known by a method that does not use light such as weighing the substrate with and without the coating. A calibration curve that relates the known thicknesses to the captured optical signals from the optical sensor is then generated so the curve can be stored in a memory operatively connected to a controller. The controller can then interpolate thicknesses for optical sensor image data received during operation of the printer. The process of correlating known coating layer thicknesses to optical sensor image data taken at different times before the printer is put into operation is called "empirical testing" in this document. The coating thickness measurement can also be identified with reference to a difference between an optical sensor capture of the imaging surface with no coating applied and another optical sensor capture with an appropriate thickness of the coating applied. This difference is then stored in a memory of the printer along with the optical sensor capture of the bare imaging surface. During printer operation, the optical sensor bare surface capture is subtracted from a current optical sensor capture of the imaging surface with a layer of coating material. This differential can then be compared to the differential stored in the memory to enable an interpolation between the two differentials to identify the thickness of the coating.

In another embodiment, a source of white light that is spatially extended in the cross-process direction is positioned near the specular reflection location of the optical sensor. The reflected light produces different colors as the coating thickness on the blanket surface varies. When these coating thicknesses are known, the different light colors can be correlated to the known thicknesses to produce a calibration curve that can be used to identify coating thicknesses during the operational life of the printer as noted above.

The optical sensor(s) used to identify a coating thickness can be placed either immediately after the SMU 92 or the sensor could be located at a position that follows the print zone. If the optical sensor is located after the print zone, only those portions of the surface that are covered by coating material alone are imaged. These regions are either outside the pitch in which an image was printed, such as inter-document zones between pitches, within blank regions of the image, or on a skipped pitch in which no image was printed.

In some printers, the blanket surface is textured and the coating material is a polymer solution that is roll coated onto the textured blanket by the SMU 92. The solution dries and leaves a thin layer of film on the blanket. A specular light reflection that has little or no color variation is increasingly produced by the textured blanket surface and smooth coating in response to the incident light as the coating thickness increases and fills the textured topography of the blanket. Inversely, a diffuse reflection is decreasingly produced by the textured blanket surface and smooth coating as the coating thickness increases and fills the textured topography of the blanket. Consequently, the optical sensor can be configured to sense either specular or diffuse reflection to identify the thickness of the coating material.

Figure 3:
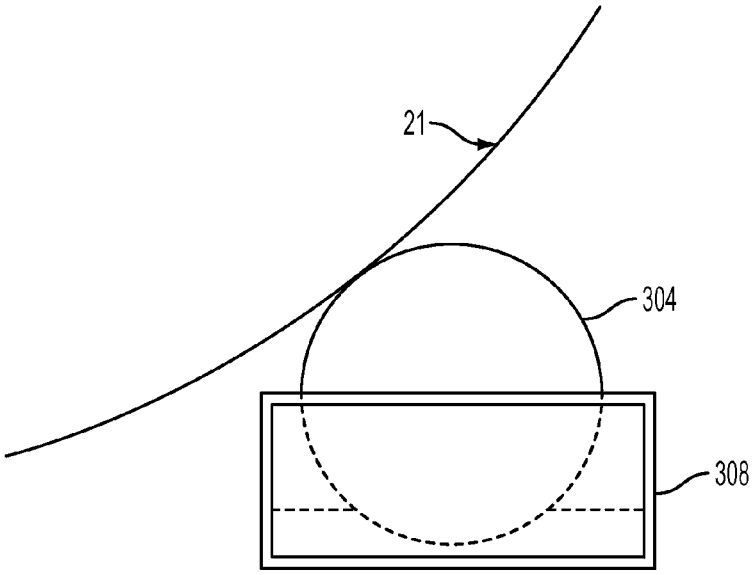
FIG. 3 is a schematic diagram of a device that uses contact to apply coating material to an imaging surface.
Figure 4:
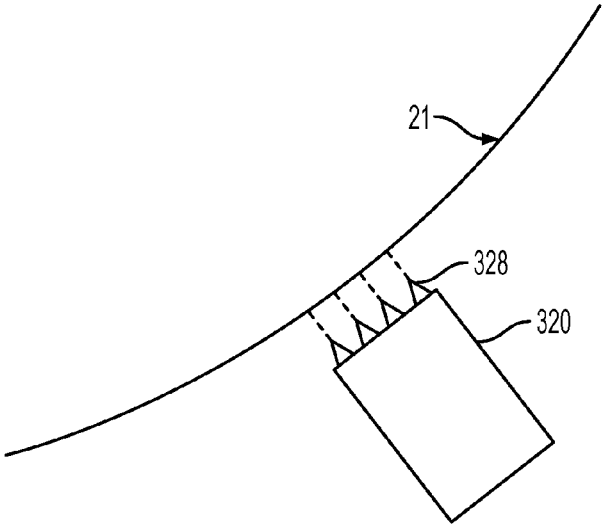
FIG. 4 is a schematic diagram of a device that ejects drops of coating material onto an imaging surface.

As shown in FIG. 3, the SMU can include a roller applicator. The roller applicator 304 can be partially immersed in a reservoir 308 of the coating material to enable the roller to pick up the coating material and apply it to the surface of the blanket 21. Another embodiment of the SMU is shown in FIG. 4. That embodiment includes an applicator head 320 having a plurality of nozzles 328 through which the coating material is ejected in a mist to form a discontinuous film of very small drops onto the blanket surface. The size of the drops would be much smaller than the size of ink drops ejected by the printheads 34A to 34D. The drops can contain compounds that induce solids in the ink to precipitate out of solution. A discontinuous film can be advantageously used with blanket surfaces having very low surface energy since liquid films, such as those produced by a roller applicator, tend to break up on low surface energy materials. If a liquid coating film breaks up then some ink drops land on the coating while other ink drops land directly on the blanket. Consequently, the applicator head is configured to produce a significant number of coating drops on the blanket for every ink drop and to distribute the drops evenly. If too few drops are ejected, the ink drops do not interact with an adequate number of drops. If too many drops are ejected, then the drops agglomerate into larger pools that may affect the uniformity of the printed surface. When a discontinuous film of the coating is used on the imaging surface, the "thickness" of the coating refers to an average thickness of the coating drops on the imaging surface.

For the ejecting type of SMU, the optical sensor can be operated in either a specular or a diffuse reflection mode so the coating drops can be most easily imaged. If the blanket has a textured surface, specular reflection of the bare surface is low and depends on the structure of the surface. The presence of small particles on the surface changes the structure of the surface and thus the amount of specular light reflection. If the blanket has a smooth surface, where smooth means the surface structure is on a scale smaller than the wavelength of the incident light, then the light is primarily specularly reflected. The presence of small droplets on the surface in general scatters the incident light and the specular reflectance decreases. In both cases, both the specular and diffuse reflectance change due to the presence of the small droplets, and the change is dependent on the coverage of the small droplets. Through a calibration or by monitoring the performance of the coating, the relation between the light detected by the sensor and either the amount of small droplets or a performance metric that depends on the amount of small droplets can be determined.

Figure 5:
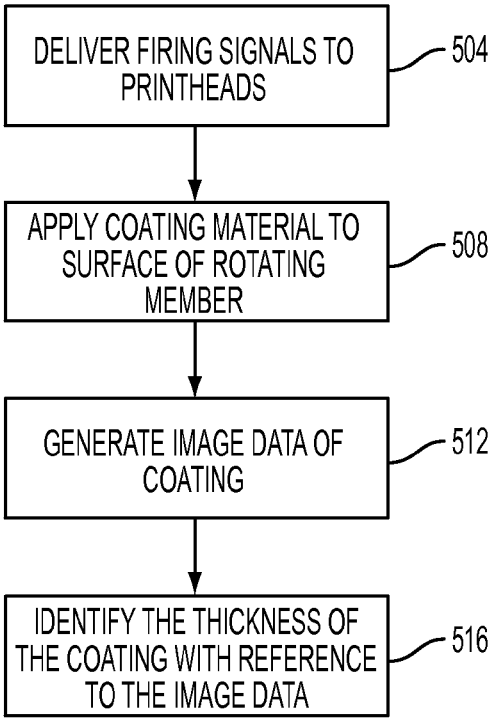
FIG. 5 is a flow diagram of a method of operating a printer that uses optical sensor image data to monitor and adjust a thickness of a coating on an imaging surface.

A method of printer operation that monitors the application of a coating to a rotating surface is shown in FIG. 5. In the description of the method, a statement that the process is performing some function refers to a processor or controller executing programmed instructions stored in a memory operatively connected to the processor or controller to operate one or more printer components to perform the function. In the process, firing signals are delivered to the printheads to eject aqueous ink onto a surface of a rotating member positioned to rotate in front of the printheads to form an aqueous ink image on the surface of the rotating member (block 504). Coating material is applied to the surface of the rotating member before the aqueous ink image is formed on the surface of the rotating member by the at least one printhead (block 508). The coating material can be applied either by a contact applicator, such as a roller, or by a liquid drop or dry particle applicator as described above. Image data of the coating on the surface of the rotating member is generated with at least one optical sensor (block 512). In some embodiments, as noted above, the optical sensor is configured to operate in a diffuse reflection mode, while in other embodiments, the optical sensor is configured to operate in a specular reflection mode. Additionally, the optical sensor can be either a sensor array that extends the full width of the imaging surface in the cross-process direction or a point optical sensor. In an embodiment that uses optical sensor 94A to generate image data of the surface of the rotating member, the image data are generated before the aqueous ink image is formed on the surface of the rotating member. In another embodiment, the optical sensor 94B is used to generate the image data after the aqueous ink image is formed. When the image data are generated after the ink image is formed, only a portion of the optical sensor image data that corresponds to the surface of the rotating member on which no aqueous ink has been ejected is used. A thickness of the coating on the surface of the rotating member is identified with reference to the optical sensor image data (block 516). The operation of the coating applicator can then be adjusted in response to the identified thickness not being within a predetermined range. In one embodiment, the predetermined range is about 0.1 μm to about 1 μm.

In one embodiment of the process, the generation of the image data includes directing light of a predetermined wavelength towards the surface of the rotating member. In this embodiment, the optical sensor image data corresponding to the reflected light are compared to data stored in a memory operatively connected to the controller that correlates a plurality of coating thicknesses to optical sensor image data obtained in empirical testing. In another embodiment, the generation of the image data includes directing white light towards the surface of the rotating member. The optical sensor image data generated by the sensor in response to the reflected white light are compared to data stored in a memory operatively connected to the controller that correlates a plurality of coating thicknesses to a plurality of reflected light colors. In another embodiment, the optical sensor data are used to identify a diffuse reflection to specular reflection ratio and this identified ratio is compared to data stored in a memory operatively connected to the controller that correlates a plurality of ratios to predetermined coating thicknesses.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

at least one printhead configured to eject liquid ink;

a rotating member being positioned to rotate in front of the at least one printhead to enable the at least one printhead to eject liquid ink and form an ink image on a surface of the rotating member;

a coating applicator positioned with reference to the rotating member to apply a coating material to the surface of the rotating member before the ink image is formed on the surface of the rotating member by the at least one printhead, the coating applicator being configured with a plurality of nozzles through which the coating material is ejected towards the rotating member;

at least one optical sensor configured to generate image data of the surface of the rotating member, the optical sensor having a light source configured to direct light of a predetermined wavelength towards the surface of the rotating member; and a controller operatively connected to the at least one optical sensor, the controller being configured to receive from the at least one optical sensor image data of the surface of the rotating member, identify a thickness of the coating on the surface of the rotating member with reference to the optical sensor image data by comparing a portion of the optical sensor image data that corresponds only to a portion of the surface of the rotating member on which no liquid ink has been ejected to data stored in a memory operatively connected to the controller that correlates a plurality of coating thicknesses to optical sensor image data obtained in empirical testing, and adjust operation of the coating applicator in response to the thickness not being within a predetermined range.

2. The printer of claim 1 wherein the predetermined range is about 0.1 μm to about 1 μm.

3. The printer of claim 1 wherein the at least one optical sensor that generates the optical sensor image data that is used to identify the coating thickness is positioned to generate image data of the surface of the rotating member before the ink image is formed on the surface of the rotating member.

4. The printer of claim 1, the at least one optical sensor being configured to respond to diffuse light reflection.

5. The printer of claim 1, the at least one optical sensor being configured to respond to specular light reflection.

6. The printer of claim 1, the at least one optical sensor being a point sensor.

7. The printer of claim 1, the coating applicator further comprising:

a roller configured to contact the rotating member to distribute coating material on the rotating member.

8. The printer of claim 1, the at least one optical sensor being configured to detect diffuse reflected light.

9. The printer of claim 1, the controller being further configured to identify a diffuse reflection to specular reflection ratio from the optical sensor image data and compare the identified ratio to data stored in a memory operatively connected to the controller that correlates a plurality of ratios to predetermined coating thicknesses.

* * * * *